US006986935B2

(12) United States Patent
Kalbe et al.

(10) Patent No.: US 6,986,935 B2
(45) Date of Patent: Jan. 17, 2006

(54) FUSIBLE INTERLINING

(75) Inventors: Michael Kalbe, Weinheim (DE); Peter Grynaeus, Birkenau (DE); Steffen Kremser, Viernheim (DE)

(73) Assignee: Carl Freudenberg KG, Weinheim (DE)

( * ) Notice: Subject to any disclaimer, the term of this patent is extended or adjusted under 35 U.S.C. 154(b) by 17 days.

(21) Appl. No.: 10/651,806

(22) Filed: Aug. 29, 2003

(65) Prior Publication Data

US 2004/0087229 A1 May 6, 2004

(30) Foreign Application Priority Data

Sep. 2, 2002 (DE) ..... 102 40 926

(51) Int. Cl.
*B32B 27/04* (2006.01)
*B32B 3/02* (2006.01)
*B32B 7/14* (2006.01)

(52) U.S. Cl. ..... 428/196; 428/195; 428/200; 428/343; 428/346; 428/354; 428/355 EP; 428/353; 442/149; 442/150; 525/131

(58) Field of Classification Search ..... 525/131; 523/453; 442/149, 150, 374; 428/355 EP, 428/353, 354, 346, 343, 200, 196, 195
See application file for complete search history.

(56) References Cited

U.S. PATENT DOCUMENTS

| | | | | |
|---|---|---|---|---|
| 5,290,594 | A | 3/1994 | Groshens et al. | 427/244 |
| 5,677,038 | A | 10/1997 | Simon et al. | 428/196 |
| 5,820,928 | A | 10/1998 | Groshens | 427/194 |
| 5,902,843 | A | 5/1999 | Simon et al. | 523/453 |
| 6,300,413 | B1 | 10/2001 | Simon et al. | 525/131 |
| 2002/0019185 | A1 | 2/2002 | Grynaeus et al. | 442/149 |

FOREIGN PATENT DOCUMENTS

| | | |
|---|---|---|
| DE | 2214236 | 10/1973 |
| DE | 2231723 | 1/1974 |
| DE | 2536911 | 2/1977 |
| DE | 3230579 | 2/1984 |
| DE | 19510316 | 9/1996 |
| DE | 10027957 | 9/2001 |
| EP | 0503204 | 9/1992 |
| EP | 0792591 | 9/1997 |
| EP | 0940461 | 9/1999 |
| EP | 1162304 | 12/2001 |
| GB | 1420497 | 1/1976 |

(Continued)

*Primary Examiner*—Arti R. Singh
(74) *Attorney, Agent, or Firm*—Davidson, Davidson & Kappel, LLC

(57) ABSTRACT

A fusible interlining includes a textile interlining web coated with a plurality of double-layered adhesive dots on a first side of the textile interlining web. Each of the plurality of double-layered adhesive dots includes a bottom dot facing the interlining web and an upper dot disposed above the bottom dot. Each bottom dot includes a binder paste containing 50 to 95 percent by weight of an acrylate binder dispersion having a glass transition temperature $T_g$<room temperature and 5 to 50 percent by weight of a substance that is one of an epoxy resin having an epoxy equivalent weight of 500 to 4000 mVal/kg and a copolymer of acrylates and monomers with at least one glycidyl side group. Each bottom dot may further include 0 to 20 percent by weight of a hardener. Each upper dot includes at least one of a copolyamide, a copolyester, a thermoplastic polyurethane and a polyolefin. A ratio of a mass of the bottom dot to a mass of the upper dot is from 1:0.5 to 1:5.

8 Claims, 1 Drawing Sheet

FUSIBLE INTERLINING

Priority is claimed to German Patent Application DE 102 40 926.9-43, filed on Sep. 2, 2002 the entire disclosure of which is incorporated by reference herein.

BACKGROUND

The present invention relates to a fusible interlining composed of a textile interlining web (such as nonwoven fabrics, woven fabrics, knitted fabrics) which is coated on one side with double-layered adhesive dots that are composed of bottom and upper dots (2,3), the bottom dots facing the interlining web and the upper dots being located above the bottom dots.

European Patent Application EP-A 0 940 461 describes a cross-linkable hot melt adhesive composition for coating and/or laminating fabrics, of which one cross-linking component is embedded in a polyolefin matrix, and the reactive components react only in the melt, forming cross-links. The specified cross-linking components are isocyanates or epoxides having molar masses between 2000 and 6000 grams per mol. In this context, the actual hot melt adhesive composition is designed to be composed of amino-terminated copolyamide or copolyester, which are used both in the bottom and upper dots. This approach has the disadvantage that, on one hand, the cross-linking component must first be incorporated, with considerable effort, in a polyolefin matrix which protects from moisture, and that the amino-terminated copolyamides have a strong tendency to yellow.

German Patent Application DE-A 195 10 316 describes a hot melt adhesive composition which is used for coating fabrics, in particular, interlining fabrics, and contains a mixture of thermoplastic hot melt adhesive and epoxide, the epoxide content being 5 to 25 percent by weight. This hot melt adhesive composition is used as a single-dot coating, involving disadvantages with respect to bleed-through of the hot melt adhesive composition in the case of very thin interlining fabrics.

Moreover, U.S. Pat. No. 5,677,038 describes two-layer hot melt adhesive compositions, whose bottom dot is composed of a copolyamide or copolyester applied in the form of a paste and whose upper dot is composed of a mixture of 0 to 25 by weight of a copolyamide, 50 to 95 percent by weight of a copolyester, and 5 to 25 percent by weight of an epoxide. For textile materials bonded using this hot melt adhesive system, the specified separation force values were below 10 N/5 cm, these values further decreasing after one washing. Besides the documents mentioned, further double-layered adhesive compositions are known from German Patent Applications DE-A 22 14 236, DE-A 22 31 723, DE-A 25 36 911 and DE-A 32 30 579. By using relatively light nonwoven fabrics, that is, nonwoven fabrics having a low weight per unit area, very soft laminates are indeed obtained, but the nonwoven fabrics have the disadvantage that they are very sensitive with respect to back-riveting of the hot melt adhesive compositions. In this context, "back-riveting" is understood to refer to an unwanted bonding between two interlining fabrics, which can occur when the interlining web coated with the adhesive composition of the dots, hereinafter referred to as fusible interlining, is bonded to the shell fabric using the interior-sandwich fixing method. In this context, the interior sandwich is composed of the following layer sequence: shell fabric, coated interlining web as well as coated interlining web, shell fabric, which means that the uncoated sides of the of the interlining webs rest against one another. The amount of coating applied per square meter of interlining web was, in fact, reduced from 18–25 g/m$^2$ previously to 7–15 g/m$^2$. However, it should be reduced further in view of the softness of the textile laminate. Along with the high demands made on adhesion and resistance of the laminate, at the same time more importance is attached to the feel. In particular, with regard to the care properties of a textile laminate, there is a requirement for it to withstand several washings at washing temperatures up to 60° C.

Double-dot systems which are used for coating interlining fabrics and which exhibit improved adhesion combined with a reduced back-riveting tendency by using epoxy resins in the bottom dots are, in fact, known from German Patent Document DE 100 27 957. In this context, however, it is a disadvantage that the feel of the interlining is negatively affected by the use of semicrystalline thermoplastics in combination with epoxides in the bottom dot. This means that the feel becomes firmer.

SUMMARY OF THE INVENTION

An object of the present invention is to provide a fusible interlining that exhibits markedly increased adhesion and separation forces and, at the same time, very little back-riveting.

The present invention provides a fusible interlining composed of a textile interlining web (1) which is coated on one side with double-layered adhesive dots that are composed of bottom and upper dots (2,3), the bottom dots facing the interlining web and the upper dots being located above the bottom dots. The bottom dots (2) are composed either of a binder paste which contains 50 to 95 percent by weight of an acrylate binder dispersion having a $T_g$<room temperature and 5 to 50 percent by weight of an epoxy resin having an epoxy equivalent weight of 500 to 4000 mVal/kg, or 50 to 95 percent by weight of an acrylate binder dispersion having a $T_g$<room temperature and 5 to 50 percent by weight of a copolymer of acrylates and monomers with glycidyl side groups and 0 to 20 percent by weight of a hardener as well as conventional auxiliary agents and additives used for producing a paste as the bottom dot (2). The upper dots (3) are composed of copolyamides and/or copolyesters and/or thermoplastic polyurethanes and/or polyolefins. The weight ratio of the masses contained in the bottom and upper dots (2,3) is 1:0.5 to 1:5.

The fusible interlining according to the present invention achieves separation forces which are still very good after several washings at temperatures of 60° C. Despite using components in the adhesive compositions (bottom dot) which have a glass transition temperature $T_g$>60° C. and which are normally out of the question for use in interlining applications because of their very negative (hardening) influence on the feel, the fusible interlinings according to the present invention have no effects on the haptic properties (feel) of the fusible interlining.

The epoxy powders consist of epoxy resins which are solid at room temperature and which represent reaction products of epichlorohydrin with bisphenol A and/or reaction products of epichlorohydrin with bisphenol F. Moreover, it is possible to use polyfunctional epoxides as the epoxy resin. These include, for example, epoxidized novolaks.

The used polyamides, polyesters, polyurethanes, polyolefins and/or vinyl copolymers having carboxyl, acid-anhydride, hydroxy and/or amido side groups are low-melting thermoplastic polymers. Moreover, it is possible to use polymer blends of low-melting polyamides, polyesters, polyurethanes, polyolefins and/or vinyl copolymers having carboxyl, acid-anhydride, hydroxy and/or amido side groups. In this context, the polymers are made up of linear or branched monomers.

The polyamide can be composed of one or more of the following monomers:

at least one carboxylic acid that is at least bifunctional, at least one amine that is at least bifunctional, at least one ω-aminocarboxylic acid at least one lactam.

The polyester is prepared from one or more of the following monomers:

at least one carboxylic acid that is at least bifunctional, at least one alcohol that is at least bifunctional, at least one ω-hydroxycarboxylic acid at least one lactone.

The polyurethanes can be composed of diisocyanates, polyols, and diols.

The hardener used is the prepolymer of epoxy resins and polyamines composed of reactions products of epoxy resins based on bisphenol A and polyamine and/or reactions products of epoxy resins based on bisphenol F and polyamine; the prepolymer also being solid at room temperature. Also usable are a prepolymer of epoxy resins and polyaminoamides composed of polyamines and dimeric fatty acids.

Preferably, the fusible interlining is one in which the average diameter of the powdery starting substances for bottom dots (2) is smaller than 100 μm, as determined by sieve analysis. In this context, the particle fineness of the starting substances promotes the reactivity and cross-linking of bottom dot (2) both inside bottom dot (2) and at the junction (4) with upper dot (3).

Moreover, the fusible interlining is preferably one in which the average diameter of the powdery starting substances for upper dots (3) is 50 to 250 μm, as determined by sieve analysis. The particle size according to the present invention for the upper dot material promotes the fusing and overcoating of bottom dots (2) with top dots (3).

The fusible interlining is obtained in that, for forming bottom dots (2), a paste of 50 to 95 percent by weight of an acrylate binder dispersion, 5 to 50 percent by weight of an epoxy resin, or of 50 to 95 percent by weight of an acrylate binder dispersion, 5 to 50 percent by weight of a copolymer of acrylates and monomers with glycidyl side groups as well as dispersants, flowpromoting agents, and thickeners is made and applied to the interlining web (1) at spatially separate points; in that the paste, while in the wet state, is sprinkled with 50 to 500 percent by weight of a copolyamide and/or copolyester and/or thermoplastic polyurethane and/or polyolefin in relation to the dry weight of bottom dots (2); in that excess dusting powder is removed; and in that the obtained fusible interlining having double-layered adhesive dots is dried at temperatures from 110 to 200° C. and made manipulable and transportable by sintering the polymeric material to the interlining web (1).

The epoxy resins used are those having softening points in the range from 70 to 130° C., preferably from 90 to 110° C., and epoxy equivalents of 500 to 4000 mVal/kg.

The hardener used is a prepolymer of epoxy resin and diethylenetriamine (1:2), or an aminic hardener.

BRIEF DESCRIPTION OF THE DRAWING

The present invention will be explained with reference to two examples and to the drawing, in which.

DETAILED DESCRIPTION

Figure 1:
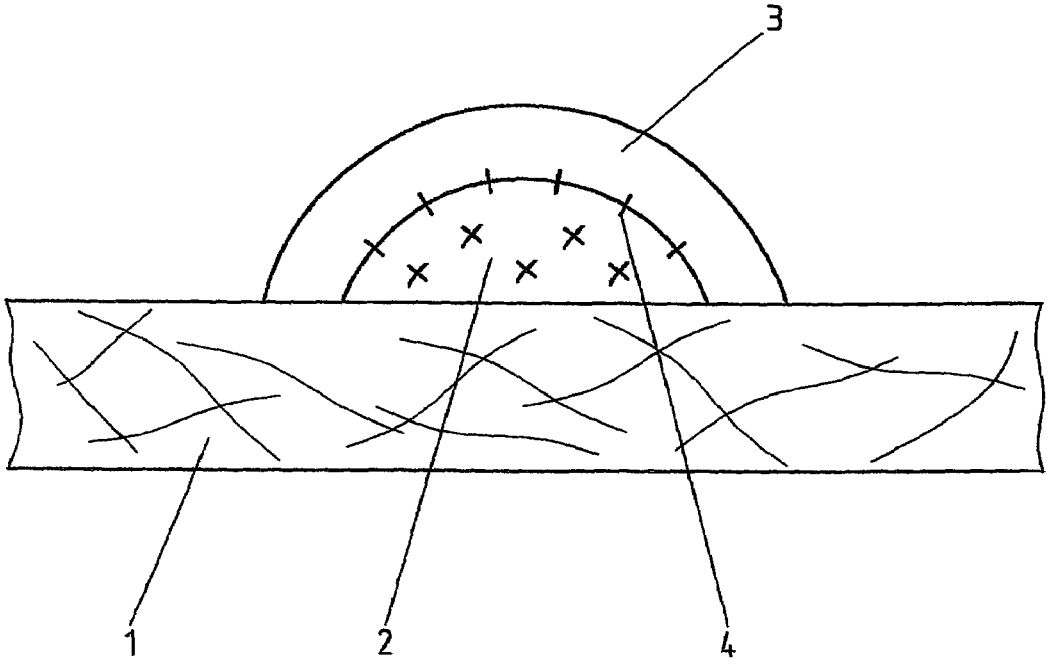
FIG. 1 shows a fusible interlining according to the present invention.

FIG. 1 shows a fusible interlining according to the present invention, where bottom dots (2) are located on an interlining web (1) preferably composed of nonwoven fabrics, the bottom dots being overcoated with upper dots (3) and cross-linked both within themselves and at the junction (4) with upper dots (3) at temperatures of 120 to 180° C., using a sintering process.

EXAMPLE 1

In a stirred vessel, a mixture of polyacrylate binder dispersion and epoxide having particle sizes <50 μm in a solid weight ratio of 70:30 is mixed with water and a paste base of dispersants, flowing agent, and thickeners to form a paste, using a conventional method. This paste is printed onto a 25 g polyamide/polyester (PA/PES) nonwoven fabric as a bottom-dot paste by stencil printing with a coated mass of 5 g/m$^2$ using a CP52 stencil. A polyamide of the grain fraction 80–200 μm is sprinkled over the still wet paste dot (2) as an upper dot (3) with a coated mass of 7 g/m$^2$, the excess is removed by suction, and subsequently the polyamide is dried and sintered on in a Mathis oven for 30 s at 180° C. The resulting total coated mass is 12 g/m$^2$.

The nonwoven fabric interlining produced in this manner was fixed to batiste.

The laminate of shell fabric and an interlining produced according to the present invention exhibits a softer feel than comparable shell fabric-interlining laminates.

| Fixing temperature | Primary adhesion | Back-riveting |
|---|---|---|
| 120° C. | 8.0 N/5 cm | 0.2 N/10 cm |
| 140° C. | 9.0 N/5 cm | 0.2 N/10 cm |

The nonwoven fabric interlinings were torn during separation force testing.

EXAMPLE 2

In a stirred vessel, a mixture of polyacrylate binder dispersion and a dispersion of an acrylate-glycidyl acrylate copolymer having particle sizes <30 μm in a solid weight ratio of 70:30 is mixed with water and a paste base of dispersant, flowing agent, and thickener to form a paste, using a conventional method. This paste is printed onto a 35 g polyamide/polyester (PA/PES) nonwoven fabric as a bottom-dot paste by stencil printing with a coated mass of 6 g/m$^2$ using a CP52 stencil. A polyamide of the grain fraction 80–200 μm is sprinkled over the still wet paste dot (2) as an upper dot (3) with a coated mass of 8 g/m$^2$, the excess is removed by suction, and subsequently the polyamide is dried and sintered on in a Mathis oven for 30 s at 180° C. The resulting total coated mass is 14 g/m$^2$. The nonwoven fabric interlining produced in this manner was fixed to batiste.

The laminate of shell fabric and an interlining produced according to the present invention exhibits a softer feel than a comparable shell fabric-interlining laminate.

| Fixing temperature | Primary adhesion | Back-riveting |
|---|---|---|
| 120° C. | 10 N/5 cm | 0 N/10 cm |
| 140° C. | 11.5 N/5 cm | 0 N/10 cm |

The nonwoven fabric interlinings were torn during separation force testing.

What is claimed is:

1. A fusible interlining comprising:

a textile interlining web coated with a plurality of double-layered adhesive dots on a first side of the textile interlining web, each of the plurality of double-layered adhesive dots including a bottom dot facing the interlining web and an upper dot disposed above the bottom dot, the bottom dot including a binder paste containing 50 to 95 percent by weight of an acrylate binder dispersion having a glass transition temperature $T_g$<room temperature and 5 to 50 percent by weight of a substance, wherein the substance is one of an epoxy resin having an epoxy equivalent weight of 500 to 4000 mVal/kg and a copolymer of acrylates and monomers with at least one glycidyl side group, and the bottom dot further including 0 to 20 percent by weight of a hardener;

the upper dot including at least one of a copolyamide, a copolyester, a thermoplastic polyurethane and a polyolefin; and wherein a ratio of a mass of the bottom dot to a mass of the upper dot is from 1:0.5 to 1:5.

2. The fusible interlining as recited in claim 1, wherein the bottom dot includes starting substances having an average diameter of less than 100 $\mu$m.

3. The fusible interlining as recited in claim 1, wherein the upper dot includes powdery starting substances having an average diameter 50 to 250 $\mu$m.

4. The fusible interlining as recited in claim 3, wherein the average diameter is determined by sieve analysis.

5. The fusible interlining as recited in claim 1, wherein the binder paste includes at least one of a dispersant, a flowing agent, and a thickener.

6. A method for manufacturing a fusible interlining comprising:

applying a paste at spatially separate points to an interlining web so as to form a plurality of bottom dots, wherein in the paste includes 50 to 95 percent by weight of an acrylate binder dispersion and 5 to 50 percent by weight of a substance that is one of an epoxy resin and a copolymer of acrylates and monomers having at least one glycidyl side group;

sprinkling the paste, while in a wet state, with an amount of dusting powder including one of a copolyamide, a copolyester, a thermoplastic polyurethane, and a polyolefin so as to form a plurality of double-layered adhesive dots, wherein the amount is 50 to 500 percent by weight of in relation to a dry weight of the bottom dots;

removing any excess of the dusting powder; and drying the double-layered adhesive dots at temperatures from 110 to 200° C. and sintering the double-layered adhesive dots to the interlining web.

7. The method as recited in claim 6, wherein the drying and sintering is performed in a manner so as to render the interlining manipulable and transportable.

8. The method as recited in claim 6, wherein the paste further includes at least one of a dispersant, a flowing agent, and a thickener.

* * * * *